United States Patent [19]

Wells

[11] 4,361,322

[45] Nov. 30, 1982

[54] BODY STRETCHING EXERCISER

[76] Inventor: David L. Wells, P.O. Box #593, Dubois, Wyo. 82513

[21] Appl. No.: 264,161

[22] Filed: May 15, 1981

[51] Int. Cl.[3] ..... A63B 23/02; A63B 21/10

[52] U.S. Cl. ..... 272/126; 272/137; 272/142

[58] Field of Search ..... 128/75, 71, 72; 272/137, 242, 116, 117, 93, 94, 126

[56] References Cited

U.S. PATENT DOCUMENTS

| | | | |
|---|---|---|---|
| 1,720,283 | 7/1929 | Mackie | 128/71 |
| 1,747,174 | 2/1930 | Knowles | 128/71 |
| 2,590,951 | 4/1952 | Farison | 272/142 |
| 3,966,200 | 6/1976 | Kirk | 272/126 |

*Primary Examiner*—George J. Marlo
*Attorney, Agent, or Firm*—Robert K. Rhea

[57] ABSTRACT

A body stretching exerciser in which head end and foot end traction units are connected with opposing vertical wall surfaces adjacent a floor and includes flexible bands encircling longitudinally spaced portions of a user's body when supine. A U-shaped member, connected with one wall by a resilient strand, has a strap around the perimeter of its bight portion forming a spreader disposing the end portions of the strap on either side of a user's head when connected with his neck or torso. A hoist or block and tackle, interposed between the other traction unit and the other adjacent wall, exerts a stretching action on the user's muscles and joints in accordance with operation of the hoist by the user of the exerciser.

4 Claims, 6 Drawing Figures

BODY STRETCHING EXERCISER

BACKGROUND OF THE INVENTION

1. Field of the Invention

The present invention relates to body exercise devices and more particularly to an apparatus for stretching the vertebra, other joints and muscles.

The purpose of stretching exercises is to lengthen muscles and increase body flexibility and in many cases relieve pain. It is important that stretching exercises be done with caution particularly when initiating a stretching program. Vigorous or aggressive stretching must be avoided. A program of daily stretching is sometimes recommended to maintain a musclo-skeletal system at its best.

2. Description of the Prior Art

Prior art patents generally relate to force resistance exercising devices for exercising and/or developing body, arm and leg muscles as opposed to this invention which features apparatus for applying oppositely directed traction forces to longitudinally spaced portions of the body wherein muscles are stretched as well as joints and ligaments.

SUMMARY OF THE INVENTION

In one embodiment, a pair of fabric panel-like bands respectively surround the upper chest area and waist and hip portions while the user is supine on a supporting surface between opposing vertical walls. A traction means, including a strap connected with the chest band and a spreader unit, is connected by a resilient strand to one wall by a screw hook. Similarly, another traction means, including a strap and spreader unit, secure the waist band to a screw hook in the opposite wall through a resilient strand and a winch or block and tackle for exerting a stretching action on the back and vertebra.

In another embodiment, the chest and waist bands are not used and a neck encircling band is similarly connected to the first wall while a pair of ankle surrounding bands are similarly connected with the other wall for applying longitudinal stretching action on the user's torso, neck and legs.

Alternatively, the neck band may be used in combination with the waist band or the ankle bands may be used in combination with the chest band.

The principal object is to provide an individually operated easily assembled and stored body joint and muscle stretching apparatus for increasing body flexibility and releaving pain, such as an aching back, neck and/or legs in one area or a combination of areas of the user's body.

DESCRIPTION OF THE PREFERRED EMBODIMENTS

Figure 2:
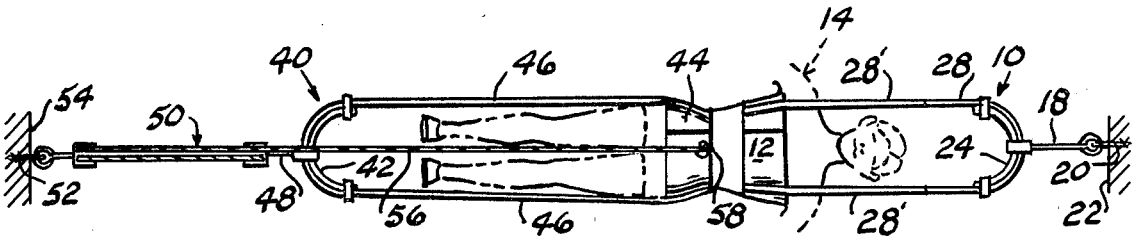
FIG. 2 is a top view of FIG. 1.
Figure 1:
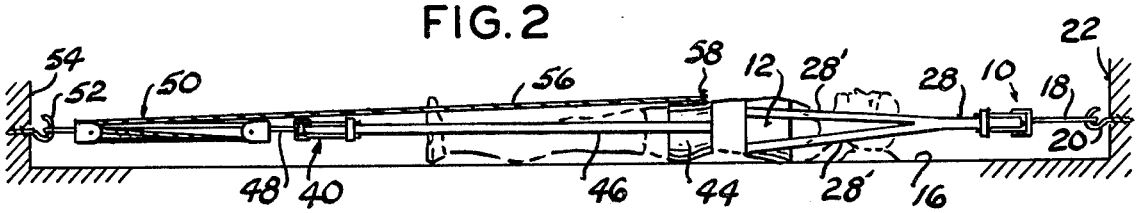
FIG. 1 is a side elevational view, partially in section, of one embodiment of the device in operative position when connected with a user, the latter being shown in phantom line.

Like characters of reference designate like parts in those figures of the drawings in which they occur.

In the drawings:

The reference numeral 10 indicates a first or head end traction means connected with a flexible panel or band 12 encircling the upper chest portion of a user's body 14 when supine on a horizontal surface, such as a floor 16. The means 10 includes an elongated resilient strand, such as a bungee cord 18, connecting it with an eye-screw or hook 20 secured to a vertical wall surface 22. The means 10 preferably comprises a spreader unit 24 formed by a metallic section of strap material arcuately curved to substantially describe a semi-circle or U-shape.

The band 12 is preferably formed from fabric material of a desired length, which encircles the upper chest area of the user 14 below his arm pits with its meeting edge portions overlapping and provided with cooperating fastening means, such as buckles, not shown, or self adhering strip members commonly known by the tradename Velcro comprising synthetic material strips 26 which separably adhere when pressed together for securing the band to the user's body.

An elongated strap 28 of fabric or leather extends intermediate its ends around the outer periphery of the U-shaped spreader 24 and is held thereon by passing through loop members 30 secured to the leg end portions 32 of the spreader. The respective end portions of the strap 28 are divided or secured to one end of a pair of straps 28' which are connected at their respective other ends with the band 12 forwardly and rearwardly of the normal depending position of the user's arms. The bight portion 34 of the spreader is provided with a closed loop-like member 36 to which one end of the bungee cord 18 is connected. The other end of the bungee cord 18 is provided with a closed loop for receiving the wall hook 20.

The reference numeral 40 indicates a second substantially identical foot traction means including an identical U-shaped spreader 42 similarly connected with a waist encircling panel or band 44 substantially identical with the band 12 by an elongated strap 46. Obviously, the straps 28 and 46 may have a buckle, not shown, interposed therein to facilitate adjusting the length of the straps as well as threading a different length strap through the spreader loops 30 and 36 for the purposes presently explained.

The purpose of the spreaders 24 and 42 is to maintain the band connected end portions of the straps 28 and 46 in spaced relation at opposing sides of the user's body and equalize the traction force.

The foot unit 40 similarly includes a second bungee cord 48 connected with a hoist 50, such as a small size block and tackle, in turn connected with an opposing wall hook 52 secured to a wall 54 opposite the wall 22. The operating end portion of the hoist rope 56 is grasped by the user to operate the hoist 50 and apply, by the traction means 10 and 40, a longitudinal pulling force on the vertebra. A hook or prong 58, secured to the waist band 44, permits the user to tie-off the rope end portion 56 to maintain constant stretching force on his vertebra without holding the rope. Obviously, a small electric hoist, connected with a source of electrical energy through a suitable switch, neither being shown, may be used in place of the hoist 50 for applying the tension or stretching action on the user's body.

Figure 3:
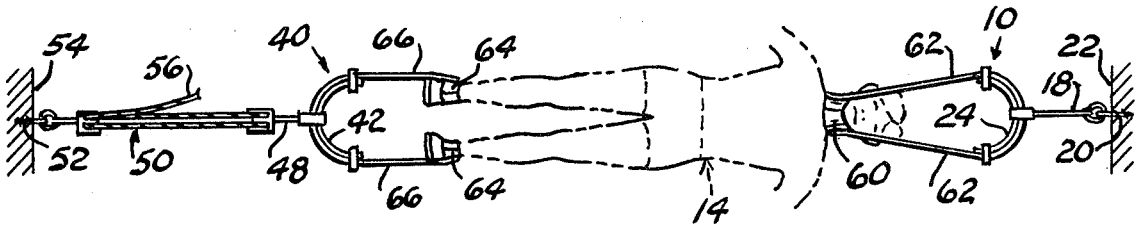
FIG. 3 is a view similar to FIG. 2 illustrating another embodiment of the device.
Figure 4:
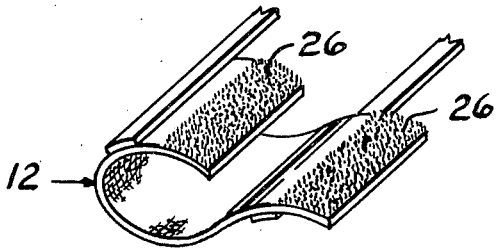
FIG. 4 is a fragmentary perspective view, to a different scale, of one of the body engaging bands.
Figure 5:
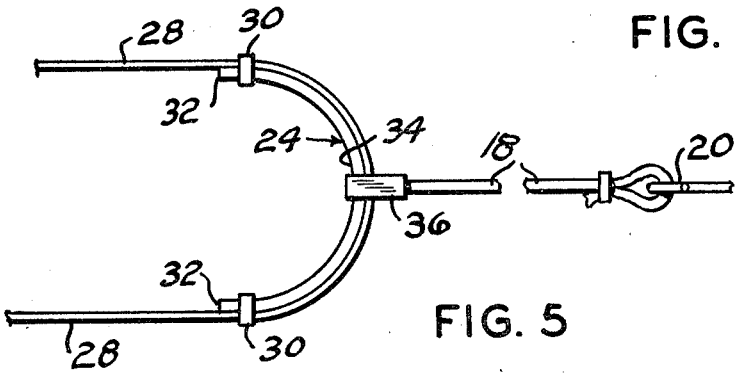
FIG. 5 is a fragmentary plan view, to a larger scale, of one end spreader unit of the device; and, FIG. 6 is a side view of FIG. 5.
Figure 6:
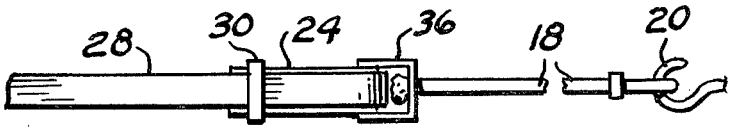

The other embodiment, illustrated by FIG. 3, applies traction to the full length of the user's body from his neck to his feet which is accomplished by replacing the chest band 12 with a similar neck encircling band 60 connected with the head end U-shaped spreader 24 by a similar but shorter length strap 62. The waist encircling band 44 is replaced by a pair of ankle encircling bands 64 which are respectively connected with the ankles and foot end U-shaped spreader 42 by a short length strap 66. Operating the hoist 50 then applies tension to the joints of the neck, back, hips and legs. Obviously, the waist band and its hook 58 may be used to tie-off the hoist rope 56 in this embodiment, if desired.

Obviously the invention is susceptible to changes or alterations without defeating its practicability. Therefore, I do not wish to be confined to the preferred embodiment shown in the drawings and described herein.

I claim:

1. A muscle and joint stretching exceriser for connection with upright supports at opposing limits of a horizontal support surface, comprising: head and foot traction means respectively connected with said upright supports and projecting toward each other, said head and foot traction means including flexible band means for surrounding longitudinally spaced portions of a user's supine body, said head traction means further including, a first horizontally disposed U-shaped member having a bight position, a first elongated resilient strand extending between the bight portion of said first U-shaped member and one said upright support, and, strap means entrained intermediate its ends around the perimeter of said first U-shaped member and connected at its respective ends with one said band means; and, hoist means interposed between one said traction means and the adjacent said upright support.

2. The exceriser according to claim 1 in which said foot traction means further includes:

a second horizontally disposed U-shaped member having a bight portion;

a second elongated resilient strand extending between and connected at its respective ends with the bight portion of said second U-shaped member and said hoist means; and, other strap means entrained around the perimeter of said second U-shaped member and connected at its respective ends with another of said band means.

3. The exerciser according to claim 1 or 2 in which said band means comprises:

an elongated flexible band; and, means secured to the respective end portions of said band for releasably joining its ends together.

4. The exerciser according to claim 3 and further including:

hook means secured to the respective said upright support for releasably connecting said head and foot traction means therewith.

* * * * *